United States Patent [19]

Genjida et al.

[11] 4,298,487

[45] Nov. 3, 1981

[54] HYDRAULIC FLUID COMPOSITIONS COMPRISING BORATE ESTERS OF OXYALKYLATED HETEROCYCLIC OR ALICYCLIC AMINES

[75] Inventors: Fumihide Genjida, Yawata; Kunio Kawakatsu, Kyoto; Motohiko Ii, Uji, all of Japan

[73] Assignee: Sanyo Chemical Industries, Ltd., Kyoto, Japan

[21] Appl. No.: 137,387

[22] Filed: Apr. 4, 1980

[30] Foreign Application Priority Data

Apr. 5, 1979 [JP] Japan ..... 54-41801

[51] Int. Cl.[3] ..... C10M 3/26; C09K 5/00

[52] U.S. Cl. ..... 252/75; 252/77; 260/460

[58] Field of Search ..... 252/75, 77, 78.1; 260/462 R

[56] References Cited

U.S. PATENT DOCUMENTS

| | | | |
|---|---|---|---|
| 3,625,899 | 12/1971 | Sawyer et al. | 252/75 |
| 3,711,410 | 1/1973 | Sawyer et al. | 252/78 |
| 3,729,497 | 4/1973 | Sawyer et al. | 260/462 R |
| 4,116,846 | 9/1978 | Sato et al. | 252/78.1 |
| 4,173,542 | 11/1979 | Sato et al. | 252/78.1 |
| 4,204,972 | 5/1980 | Knoblauch et al. | 252/78.1 |

FOREIGN PATENT DOCUMENTS

| | | | |
|---|---|---|---|
| 52-47702 | 2/1977 | Japan | 252/77 |

*Primary Examiner*—P. E. Willis, Jr.

*Attorney, Agent, or Firm*—Oblon, Fisher, Spivak, McClelland & Maier

[57] ABSTRACT

Hydraulic fluid compositions having improved properties to rubbers are formed from (A) a nitrogen-atom-containing borate ester derived from an oxyalkylated heterocyclic or alicyclic amine and (B) another borate ester and/or polyoxyalkylene compound.

32 Claims, No Drawings

HYDRAULIC FLUID COMPOSITIONS COMPRISING BORATE ESTERS OF OXYALKYLATED HETEROCYCLIC OR ALICYCLIC AMINES

BACKGROUND OF THE INVENTION

1. Field of the Invention

This invention relates to hydraulic fluid compositions, particularly hydraulic fluid compositions containing borate esters.

2. Description of the Prior Art

In recent years, hydraulic fluid compositions are required to have high boiling points. Thus, they are required to be of the DOT-4 grade, for instance. As those hydraulic fluids that have high boiling points, there are widely known borate ester type fluids. However, the known borate ester type hydraulic fluids are inferior in behavior to rubber to hydraulic fluids of the polyoxyalkylene type. The borate ester type fluids have a drawback that, in a rubber swelling test, they cause formation of a large amount of precipitate. Accordingly, it is feared that, when an automobile is running, for instance, such rubber additives as fatty acids and zinc oxide be extracted from the rubber cup used in the brake mechanism into the brake fluid, causing turbidity or forming a precipitate. Such fatty acids, zinc oxide and other extracted substances may react with metal components used in the cylinder, piping and so on, to cause formation of an insoluble precipitate, which may lead to clogging of the piping or the like.

For dissolving this problem, it has already been proposed to use borate esters having a semipolar structure (e.g. a reaction product of 2 moles of glycerol and 1 mole of boric acid). However, such borate esters are still unsatisfactory.

SUMMARY OF THE INVENTION

Accordingly, it is one object of this invention to provide hydraulic fluid compositions having improved properties to rubbers and high boiling points.

It is another object of this invention to provide hydraulic fluid compositions which can meet the requirements for DOT 4 grade.

Briefly, these and other objects of the invention as hereinafter will become more readily apparent have been attained broadly by providing hydraulic fluid compositions which comprise (A) a nitrogen-atom-containing borate ester having the formula:

$$B\begin{cases}[O-(A_1O)_{m1}-R_1]_x \\ [O-(A_2O)_{m2}-R_2]_y \\ [OR_3]_z\end{cases} \quad (1)$$

[wherein $A_1$ and $A_2$ are independently $C_2$–$C_4$ alkylene, $R_1$ and $R_2$ are independently $C_1$–$C_4$ alkyl, m1 and m2 are independently 2 to 8, $R_3$ is a residue of an oxyalkylated heterocyclic amine or of an oxyalkylated alicyclic amine, x and y are zero, 1 or 2, z is 1, 2 or 3, and x, y and z satisfy the equation $x+y+z=3$, and when z is 2 or 3, $R_3$ are same or different], or a mixture thereof; and (B) at least one fluid selected from the group consisting of (a) other borate esters, (b) polyoxyalkylene compounds, and (c) mixtures of (a) and (b), wherein (A) presents in sufficient amount for preventing formation of precipitates in a rubber swelling test.

DETAILED DESCRIPTION OF THE PREFERRED EMBODIMENTS

[A] N-CONTAINING BORATE ESTER

In this invention, the residue of the oxyalkylated, heterocyclic or alicyclic amine [$R_3$ in the formula (1)] means the group obtained by eliminating a hydroxyl group from the oxyalkylated amine.

The oxyalkylated heterocyclic or alicyclic amine in this invention is a compound which can be considered to be in structure an addition product of at least one alkylene oxide with a heterocyclic or alicyclic amine having at least one active hydrogen atom. The compound may be produced by any known method. For convenience, however, a detailed explanation of said addition product will be given hereinafter.

Suitable heterocyclic amines include secondary amino group-containing heterocyclic compounds having the formula:

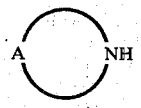

wherein A is a divalent organic radical, for example, divalent hydrocarbon radical which may contain (or substituted with) one or more other hetero atoms such as O, N and S.

Examples of such heterocyclic amines are as follows:

(1) [A: hydrocarbon radical]: pyrrolidine, piperidine, pyrrolines, pyrrole, indoline, isoindoline, indole, isoindole, carbazole, and the like;

(2) [A: O-containing radical]: morpholine, xanthene, pyrrolidones such as 2-pyrrolidone, and the like;

(3) [A: N-containing radical]: imidazolines, imidazole, pyrazole, pirazolines, purine, 1-H-indazole, piperazine, N-alkyl ($C_{1-4}$) piperazines, imidazolidine, N-alkyl ($C_{1-4}$) imidazolidine, and the like, and (4) [A: S-containing radical]: phenothiazine, and the like.

Primary amino group-containing heterocyclic compounds, for example, N-aminoalkyl ($C_{1-4}$) substituted derivatives of the above secondary amino group-containing hterocyclic compounds, may be used.

Preferred are heterocyclic monoamines. More preferred are pyrrolidine, piperidine and morpholine.

Suitable alicyclic amines includes alicyclic monoamines such as cyclohexylamine, alkyl ($C_{1-4}$) cyclohexylamines, and dicyclohexylamine, and the like; and alicyclic polyamines such as 1,4-diaminocyclohexane, 4,4'-dicyclohexyl methane diamine, and the like. Preferred are alicyclic monoamines. More preferred is cyclohexylamine.

Suitable alkylene oxides include, for example, those having 2 to 4 carbon atoms such as ethylene oxide (EO), propylene oxide (PO); 1,2-, 2,3- or 1,3-butylene oxide (BO), tetrahydrofuran and combinations of at least two of these alkylene oxides (such as a combination of PO and EO). Preferred are EO and/or PO. More preferred is EO.

The amounts of the alkylene oxide to be added to the heterocyclic or alicyclic amine are usually 1 to 8, preferably 1 to 3 moles per mole of the amine. It is preferred from the viewpoint of low viscosity at low temperatures (e.g. −40° C.) that the N-containing borate esters in the present invention do not contain any free hydroxyl groups. Thus, in case an alkylene oxide is added to a primary mono- or polyamine (e.g. cyclohexylamine, 1,4-diaminocyclohexane), the addition of the alkylene oxide should preferably be carried out in a manner such that, when a borate ester is produced by using the adduct, no free hydroxyl groups, exist in said borate ester. It is thus preferred, for example, to add 1 mole of the alkylene oxide to only one of two active hydrogen atoms in the primary amino group.

Examples of the oxyalkylated, heterocyclic or alicyclic amine are as follows:

(i) Oxyalkylated heterocyclic amines: N-(hydroxyethyl)pyrrolidine, N-(hydroxyethyl)morpholine, N-(hydroxyethoxyethyl)morpholine, N-(2-hydroxypropyl)-pyrrolidine, N-(2-hydroxypropyl)morpholine, N-(hydroxyethoxyisopropyl)morpholine, etc.

(ii) Oxyalkylated alicyclic amines: N-(hydroxyethyl)-cyclohexylamine, N, N-di(hydroxyethyl)cyclohexylamine, N-(hydroxyethyl)dicyclohexylamine, N-(hydroxyethyl)-N-(2-hydroxypropyl) cyclohexylamine, etc.

Preferred are N-(hydroxyethyl)morpholine and N-(hydroxyethyl)cyclohexylamine.

Suitable residues can be shown by the formula:

$$-(A_3O)_R-A_3-R'_3$$

wherein $A_3$ is $C_2$–$C_4$ alkylene, r is 0 to 7 (preferably 0 to 4), and $R'_3$ is a residue of a heterocyclic or alicyclic amine (preferably monoamines).

One or more polyglycol monoether having the formulae (2) and (3) may constitute a structural component of the N-containing borate esters of the formula (1).

$$R_1(OA_1)_{m1}OH \quad (2)$$

$$R_2(OA_2)_{m2}OH \quad (3)$$

Suitable polyglycol monoethers include, for example, monomethyl, monoethyl, monopropyl (n- and iso-) and monobutyl (n-, iso-, sec- and tert-) ethers of polyalkylene glycol such as diethylene glycol, triethylene glycol, tetraethylene glycol, pentaethylene glycol, dipropylene glycol, tripropylene glycol, tetrapropylene glycol, addition products of 1 to 4 moles of propylene oxide (po) with ethylene glycol, diethylene glycol and triethylene glycol and mixtures thereof, respectively. Preferred are diethylene glycol monomethyl ether, triethylene glycol monomethyl ether, tetraethylene glycol monomethyl ether, triethylene glycol monoethyl ether, and addition products of 1 to 2 moles of PO with diethylene glycol monomethyl ether.

Examples of the N-containing borate esters of formula (1) are as follows:

[A-I] Borate esters derived from oxyalkylated heterocyclic amines.

(A-I-1) Borate esters each having a residue of an oxyalkylated heterocyclic amine.

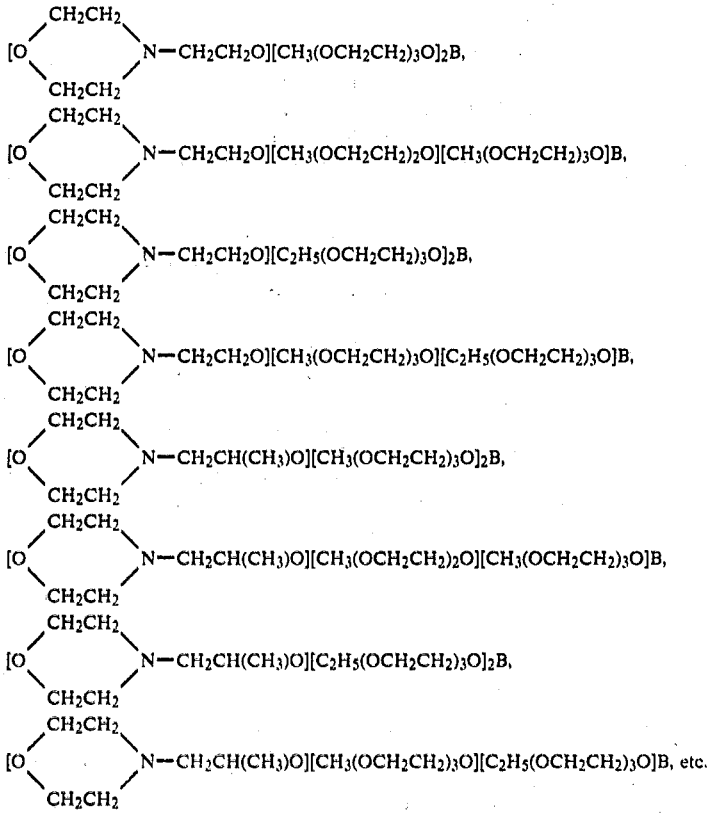

(A-I-2) Borate esters each having two oxyalkylated heterocyclic amine residues

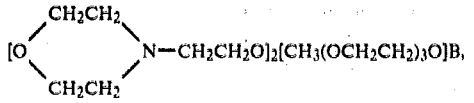

-continued

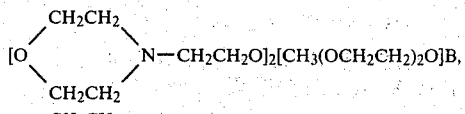

$[O(CH_2CH_2)_3N]-CH_2CH_2O]_2[CH_3(OCH_2CH_2)_2O]B$,

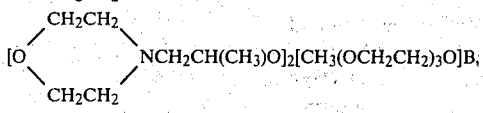

$[O(CH_2CH_2)_3N]CH_2CH(CH_3)O]_2[CH_3(OCH_2CH_2)_3O]B$,

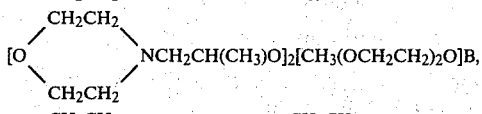

$[O(CH_2CH_2)_3N]CH_2CH(CH_3)O]_2[CH_3(OCH_2CH_2)_2O]B$,

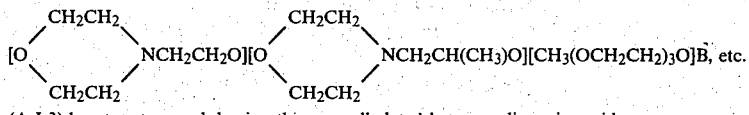

$[O(CH_2CH_2)_3N]CH_2CH_2O][O(CH_2CH_2)_3N]CH_2CH(CH_3)O][CH_3(OCH_2CH_2)_3O]B$, etc.

(A-I-3) borate esters each having three oxyalkylated heterocyclic amineresidues

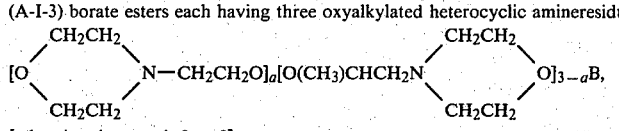

$[O(CH_2CH_2)_3N]-CH_2CH_2O]_a[O(CH_3)CHCH_2N(CH_2CH_2)_3O]_{3-a}B$,

[wherein a is zero, 1, 2 or 3] etc.

[A-II] Borate esters derived from oxyalkylated alicyclic amines (A-II-1) Borate esters each having a residue of an oxyalkylated alicyclic amine

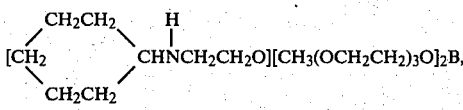

$[CH_2(CH_2CH_2)_2]CHNCH_2CH_2O][CH_3(OCH_2CH_2)_3O]_2B$,

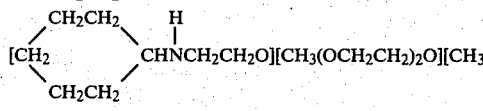

$[CH_2(CH_2CH_2)_2]CHNCH_2CH_2O][CH_3(OCH_2CH_2)_2O][CH_3(OCH_2CH_2)_3O]B$,

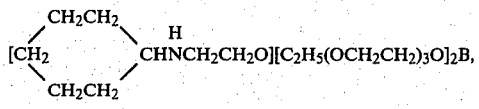

$[CH_2(CH_2CH_2)_2]CHNCH_2CH_2O][C_2H_5(OCH_2CH_2)_3O]_2B$,

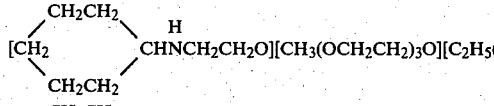

$[CH_2(CH_2CH_2)_2]CHNCH_2CH_2O][CH_3(OCH_2CH_2)_3O][C_2H_5(OCH_2CH_2)_3O]B$,

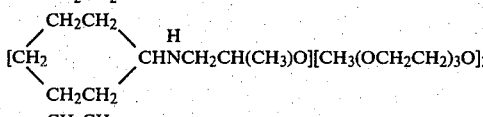

$[CH_2(CH_2CH_2)_2]CHNCH_2CH(CH_3)O][CH_3(OCH_2CH_2)_3O]_2B$,

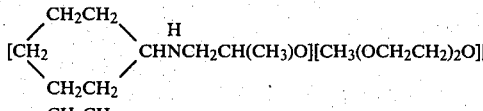

$[CH_2(CH_2CH_2)_2]CHNCH_2CH(CH_3)O][CH_3(OCH_2CH_2)_2O][CH_3(OCH_2CH_2)_3O]B$,

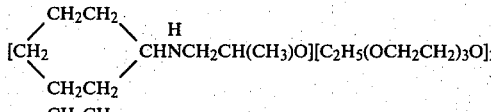

$[CH_2(CH_2CH_2)_2]CHNCH_2CH(CH_3)O][C_2H_5(OCH_2CH_2)_3O]_2B$,

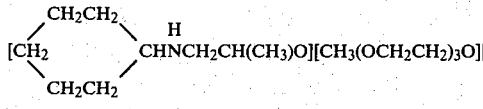

$[CH_2(CH_2CH_2)_2]CHNCH_2CH(CH_3)O][CH_3(OCH_2CH_2)_3O][C_2H_5(OCH_2CH_2)_3O]B$, etc.

(A-II-2) Borate esters each having two oxyalkylated alicyclic amine residues

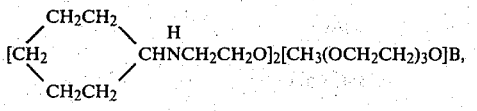

$[CH_2(CH_2CH_2)_2]CHNCH_2CH_2O]_2[CH_3(OCH_2CH_2)_3O]B$,

-continued

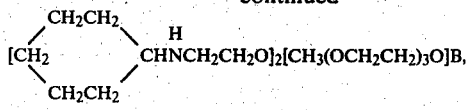

$[CH_2(CH_2CH_2)_2]CHNCH_2CH_2O]_2[CH_3(OCH_2CH_2)_3O]B$,

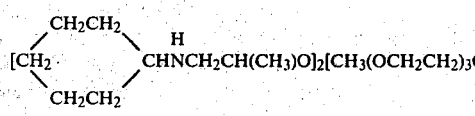

$[CH_2(CH_2CH_2)_2]CHNCH_2CH(CH_3)O]_2[CH_3(OCH_2CH_2)_3O]B$,

-continued

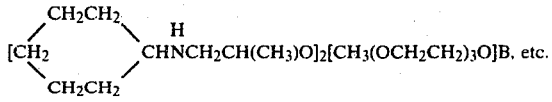

(A-II-3) Borate esters each having three oxyalkylated alicyclic amine residues

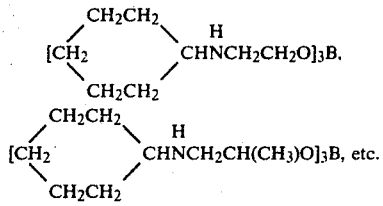

[A-III] Borate esters derived from oxyalkylated heterocyclic amines and oxyalkylated alicyclic amines

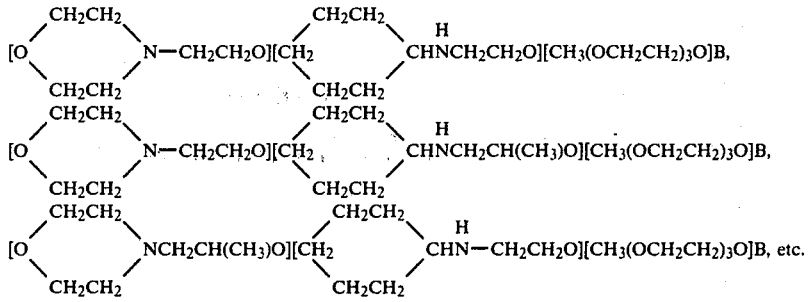

Preferred are the borate esters of the (A-I-1), (A-I-2), (A-I-3) and (A-II-1) groups. More preferred are

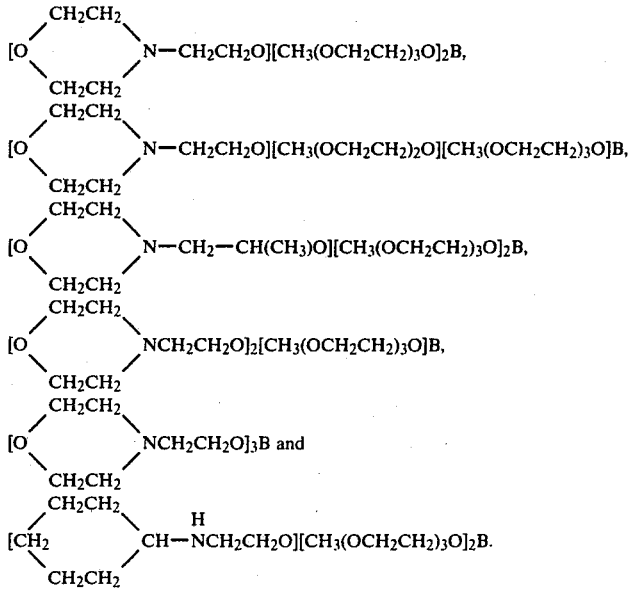

The above N-containing borate esters may be produced by any known method. Generally, they can easily be synthesized by heating (1) the oxyalkylated heterocyclic and/or alicyclic amine alone or in combination with the polyoxyalkylene monoalkylether with (2) a boron compound capable of forming a borate ester such as boric anhydride, orthoboric acid or metaboric acid (preferably boric anhydride) at, for example, 50° to 200° C. under reduced pressure, for example, 100 to 1 mmHg. The reaction is preferably carried out until the boron compound is completely esterified.

[B] OTHER BORATE ESTER and/or POLYOXYALKYLENE COMPOUND

The fluid (B) used in conjunction with the N-containing borate ester (A) may be (a) one or more borate esters other than (A), (B) one or more polyoxyalkylene compounds, or (c) a combination of (a) and (b).

(a) OTHER BORATE ESTERS

The borate ester (a) are not particularly critical. Suitable borate esters include (a) a reaction product of components (I), (II) and/or (III) with (IV), or mixtures thereof, wherein:

(I) is at least one polyglycol monoether of the formula (4):

$$R—(OA_4)_{m4}—OH \quad (4)$$

wherein R is $C_1$–$C_4$ alkyl, $A_4$ is $C_2$–$C_4$ alkylene and m4 is 2 to 8;

(II) is at least one polyglycol of the formula (5):

$$H—(OA_3)_{m5}—OH \quad (5)$$

wherein $A_3$ is $C_2$–$C_4$ alkylene and m5 is 2 to 10;

(III) is at least one polyoxyalkylene mono- or polyol of the formula (6):

$$R_4[-(OA_6)_q-OH]_p \quad (6)$$

wherein $R_4$ is a residue of a $C_1$–$C_8$ mono-ol or $C_1$–$C_8$ poly-ol, $A_6$ is $C_2$–$C_4$ alkylene, p is 1 to 4 and q is a number such that the molecular weight of component (III) is 1,000 to 5,000; and (IV) is at least one boron compound having an ability to form borate esters.

Examples of polyglycol monoether (I) are those having the formula (2) or (3) that have been mentioned in relation to the N-containing borate esters. Preferred are diethylene glycol monomethyl ether, triethylene glycol monomethyl ether, tetraethylene glycol monomethyl ether, pentaethylene glycol monomethyl ether, hexaethylene glycol monomethyl ether, triethylene glycol monoethyl ether, triethylene glycol monobutyl ether, tetraethylene glycol monoethyl ether, tetraethylene glycol monobutyl ether, and addition products of 1 to 3 moles of PO with diethylene glycol monomethyl ether or triethylene glycol monomethyl ether. More preferred are triethylene glycol monomethyl ether, triethylene glycol monoethyl ether, triethylene glycol monobutyl ether, tetraethylene glycol monomethyl ether, tetraethylene glycol monoethyl ether and tetraethylene glycol monobutyl ether.

Suitable polyglycols (II) include, for example, diethylene glycol, triethylene glycol, tetraethylene glycol, polyethylene glycol (M.W.[an average molecular weight]200–300), tripropylene glycol, polypropylene glycol (M.W. 200–400) and random or block reaction products of EO and PO with ethylene glycol or diethylene glycol (M.W. 200–400), and mixtures thereof. Preferred are diethylene glycol, triethylene glycol and polyethylene glycol (M.W. 200–300).

(In this specification all molecular weights are number-average molecular weights and are measured by hydroxyl value.)

Suitable polyoxyalkylene mono- or poly-ols (III) include, for example, random addition products of EO and PO with mono-ols (monohydric alcohols such as methanol, ethanol, propanol and butanol); addition products of PO with poly-ols (polyhydric alcohols such as ethylene glycol, propylene glycol, glycenine, trimethylol propane and pentaerythritol); and random addition products of EO and PO with the foregoing poly-ols. Preferred are random addition products of EO and PO with butanol, addition products of PO with glycenine and random addition products of EO and PO with glycerine.

Suitable boron compounds (iv) having an ability to form borate esters, include boric anhydride, orthoboric acid and methoboric acid. Preferred is boric anhydride.

The borate esters (a) can easily be synthesized in general by heating at least one of (I), (II) and (III) with (IV) at, for example, 50° to 200° C. under reduced pressure, for example 100 to 1 mmHg. The reaction is preferably carried out until the boron compound is completely esterified.

The foregoing borate esters include compounds or mixtures thereof having the formula (7):

$$\begin{array}{l} \quad\;\; [O(A_4O)_{m4}-R]_{x'} \\ B-[O(A_5O)_{m5}-H]_{y'} \\ \quad\;\; O\{-(A_6O)_q-R_4-[(OA_6)_q-OH]_{p-1}\}_{z'} \end{array} \quad (7)$$

wherein x', y' and z' are independently zero or an integer from 1 to 3, and satisfy the equation $x'+y'+Z'=3$, and the other symbols are as defined above.

Boron content of the borate ester (a) is usually 0.1–4.6% by weight preferably 0.2–1.6% by weight.

Suitable examples of borate esters (a) are those described in U.S. Pat. No. 4,173,542, No. 4,116,846 and No. 3,972,822. Other examples include those in U.S. Pat. No. 3,711,410 and No. 3,925,223, British Pat. No. 1,214,171, No. 1,232,369 and 1,232,370, German Offen. No. 2438038.

(b) POLYOXYALKYLENE COMPOUND

Suitable polyoxyalkylene compounds (b) include (i) polyglycol mono or diethers having the formula:

$$R_5(OA_7)_{m7}OR_6 \quad (8)$$

wherein $A_7$ is $C_2$–$C_4$ alkylene, $R_5$ is $C_1$–$C_4$ alkyl, $R_6$ is H or $C_1$–$C_4$ alkyl and m7 is 2 to 8, (ii) polyglycol having the formula:

$$H(OA_8)_{m8}-OH \quad (9)$$

wherein $A_8$ is $C_2$–$C_4$ alkylene and m8 is 2 to 10.

(iii) polyoxyalkylene mono- or polyols having the formula:

$$R_7-[(OA_g)_{q'}-OH]_{p'} \quad (10)$$

wherein $R_7$ is a residue of a $C_1$–$C_8$ monool or $C_1$–$C_8$ polyol, $A_9$ is a $C_2$–$C_4$ alkylene, p' is 1 to 4 and q' is a number such that the molecular weight of polyoxyalkylene mono- or polyol (iii) is 1000 to 5000, and (iv) mixtures of two or more of (i), (ii), (iii), and (iv).

Suitable polyglycol monoethers (i), polyglycols (ii), polyoxyalkylene mono- or polyols (iii) are the same ones as described for components (I), (II) and (III), respectively, in the borate ester (a).

Suitable polyglycol diethers (i) include diethers corresponding to the above polyglycol monoethers, for example, tripropyleneglycol dimethyl ether.

[C] ADDITIONAL COMPONENTS

Additional components (C) may be incorporated into the hydraulic fluid compositions of this invention. Suitable examples of such components include antioxidants such as phenyl-alphanaphthylamine, di-n-butylamine, 2,4-dimethyl-6-tert-butylphenol and 4,4-butylidenebis (6-tert-butyl-m-cresol); corrosion inhibitors such as alkanolamines (including mono-, di and triethanolamines), morpholine, N-ethanolmorpholine, cyclohexylamine, benzotriazole and mercaptobenzothiazole; rubber age resisters such as 2,4-dimethyl-6-tert butylphenol; PH adjusters such as mono-, di- and triethanolamine; anti-form agents and the like.

[D] COMPOSITION

The hydraulic fluid compositions of the present invention comprise the above-mentioned components (A) and (B). In the composition of this invention, contents of (A) and (B) are not especially critical and can vary widely within the scope of this invention, but the content of (A) is generally 10 to 45% by weight (preferably 15 to 35% by weight) and the content of (B) is usually 55 to 90% by weight (preferably 65 to 85% by weight) based on the total weight of the hydraulic fluid composition. With contents of less than 10% by weight of (A), the effect of preventing formation of a precipitate as revealed in a rubber swelling test is poor. Contents of (A) exceeding 45% by weight cause increase in viscosity at a low temperature (−40° C.).

The content of borate ester (a) is generally 0 to 90%, preferably 0 to 50% by weight. Within the range of 0 to 90% by weight, the wet boiling point of the hydraulic fluid composition is efficiently elevated.

The hydraulic fluid compositions of this invention have a boron content of usually 0.2 to 1.6% by weight. When the content is less than 0.2% by weight, the wet equilibrium reflux boiling point does not pass the standard of DOT 4, while when the content exceeds 1.6% by weight, the resistance to hydrolysis of the borate esters becomes insufficient.

Total amount of the borate esters (A) and (a) is usually 10 to 80%, preferably 10 to 60%, more preferably 15 to 50%, based on the total weight of the composition.

Ratio of (A): (a) may be varied widely, but the weight ratio of (A): (a) is usually 100:0 to 10:90, preferably 100:0 to 50:50.

The content of polyglycol ether (i) is generally 0 to 80%, preferably 40 to 70 more preferably 45 to 65%, based on the whole hydraulic fluid composition. Within the content range of 0 to 80% by weight, any significant increase in viscosity at a low temperature (−40° C.) is not caused but loss by evaporation is efficiently prevented.

The total content of polyglycol (ii) and polyoxyalkylene mono- or polyol (iii) is generally 0 to 40% by weight, preferably 10 to 35% by weight, based on the weight of the whole hydraulic fluid composition. When the content falls within the range of 0 to 40% by weight, no significant increase is found in viscosity at a low temperature (−40° C.) and moreover possible hydrolysis of the borate ester can be prevented and loss by evaporation is effectively decreased.

The total amount of the additional components (C) is usually 0 to 10% (preferably 0.1 to 5%) by weight based on the total weight of the fluid composition.

The hydraulic fluid compositions of the present invention have high boiling points and show excellent behavior to rubbers, namely, improved non-swelling properties and anti-settling properties (no or lower tendency to form precipitates) in a rubber swelling test. (The rubber swelling test can be conducted according to JIS K 2233 Specification.) In addition, those properties that are required of hydraulic fluids, such as viscosity characteristics, heat resistance, cold resistance and noncorrosiveness to metals, are never impaired.

Those N-containing borate esters that are produced by using diethanolamine, triethanolamine or the like on the analogy of this invention unfavorably cause increase in viscosity at low temperatures.

Having generally described the invention, a more complete understanding can be obtained by reference to certain specific examples, which are included for purposes of illustration only and are not intended to be limiting unless otherwise specified. In the examples, % designates % by weight, EO and PO designate ethylene oxide and propylene oxide, respectively, M.W. designates an average molecular weight and EO/PO = 50/50 designates a ratio of EO to PO = 50:50 by weight.

EXAMPLE 1

Hydraulic fluid compositions according to the invention, fluids A–E, and conventional fluids F–G were prepared.

| | |
|---|---|
| Fluid A | |
| 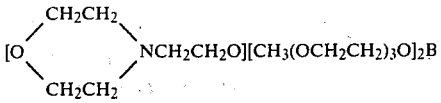 | 40% |
| $CH_3(OCH_2CH_2)_3OH$ | 55% |
| $CH_3(OCH_2CH_2)_2OH$ | 5% |
| Fluid B | |
| 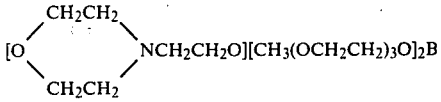 | 20% |
| $CH_3(OCH_2CH_2)_3OH$ | 75% |
| $CH_3(OCH_2CH_2)_2OH$ | 5% |
| Fluid C | |
| 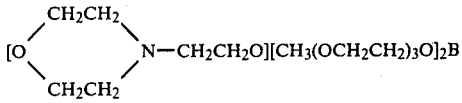 | 30% |
| $OH_3(OCH_2CH_2)_3OH$ | 50% |
| $C_2H_5(OCH_2CH_2)_2OH$ | 15% |
| $H(OCH_2CH_2)_nOH$ (M.W. 200) | 5% |
| Fluid D | |
| 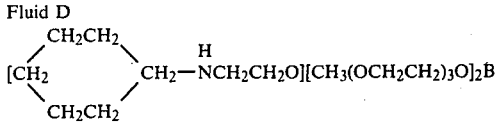 | 30% |
| $CH_3(OCH_2CH_2)_3OH$ | 70% |
| Fluid E | |
| 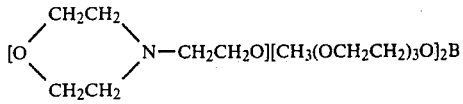 | 20% |
| 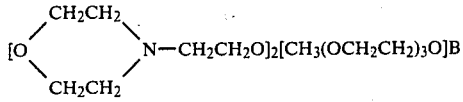 | 5% |
| 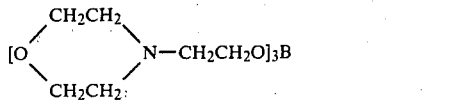 | 5% |
| $CH_3(OCH_2CH_2)_3OH$ | 70% |
| Fluid F (Conventional fluid of borate ester type) | |
| $[CH_3(OCH_2CH_2)_3O]_3B$ | 30% |
| $CH_3(OCH_2CH_2)_4OH$ | 7% |
| $CH_3(OCH_2CH_2)_3OH$ | 63% |
| Fluid G (Conventional fluid of polyoxyalkylene type) | |
| $CH_3(OCH_2CH_2)_3OH$ | 60% |
| $H(OCH_2CH_2)_3OH$ | 15% |
| A random addition product of EO and PO with n-butanol (EO/PO = 50/50 (by wt.), M.W. 1500) | 25% |

EXAMPLE 2

Fluids A–G were tested for some principal properties that are important in evaluating hydraulic fluids and also tested for ability to cause swelling of rubber. The results are shown in Table 1.

The test for rubber swelling activity was conducted according to JIS K 2233 Specification (120° C., 70 hours).

TABLE 1

| | Fluids of the invention | | | | | Convention fluids | |
|---|---|---|---|---|---|---|---|
| | Fluid A | Fluid B | Fluid C | Fluid D | Fluid E | Fluid F | Fluid G |
| Reflux boiling point (dry) °C. | 255 | 252 | 254 | 253 | 253 | 254 | 250 |
| Reflux boiling point (wet) °C. | 170 | 160 | 163 | 165 | 166 | 163 | 144 |
| Viscosity −40° C., CS | 977 | 490 | 815 | 754 | 1306 | 460 | 1452 |
| Rubber swelling activity rate of swelling (%) | 3.2 | 2.3 | 2.7 | 2.8 | 3.0 | 1.2 | 1.8 |
| volume of precipitate (vol %) | 0.10 | 0.15 | 0.15 | 0.15 | 0.15 | 1.00 | 0.10 |

*Boiling point after addition of 3.5% of water

The results given in Table 1 show that the fluids of this invention are superior to the conventional fluid of the borate ester type in lowness of volume of precipitate (test for rubber swelling activity) and to the conventional fluid of the polyoxyalkylene type in highness of reflux boiling point (wet).

EXAMPLE 3

Fluids F–I were prepared, and tested for some principal properties and rubber swelling activity.

TABLE 2

| | Fluid F (Fluid of the invention) | Fluid G (Convention fluid) | Fluid H (Fluid of the invention) | Fluid I (Convention fluid) |
|---|---|---|---|---|
| $(O\langle CH_2CH_2 \rangle NCH_2CH_2O)[CH_3(OCH_2CH_2)_3{-}O]_2B$ | 30.0 | — | 15.0 | — |
| $[CH_3(OCH_2CH_2){-}O]_3B$ | — | 32.1 | 20.0 | 36.0 |
| $O\langle CH_2CH_2 \rangle NCH_2CH_2OH$ | — | 8.4 | — | 4.2 |
| $CH_3(OCH_2CH_2)_3OH$ | 50.0 | 39.5 | 65.0 | 64.2 |
| $CH_3{-}(OCH_2CH_2)_2{-}OH$ | 15.0 | 15.0 | — | — |
| $H(OCH_2CH_2)_nOH$(M.W. 200) | 5.0 | 5.0 | — | — |

TABLE 2

| | JIS Specification | Fluid F | Fluid G | Fluid H | Fluid I |
|---|---|---|---|---|---|
| Reflux boiling point (dry) °C. | >230 | 254 | 253 | 256 | 254 |
| Reflux boiling point (wet) °C.*1 | >155 | 163 | 163 | 165 | 164 |
| Viscosity −40° C. cst | <1800 | 815 | 834 | 645 | 652 |
| Evaporation loss*2 (%) | <80 | 71 | 80 | 70 | 77 |
| flow point after the test (°C.) | <−5 | OK | OK | OK | OK |
| Rubber swelling activity*3 rate of swelling (%) | 0.5–4.9 | 2.7 | 2.5 | 1.5 | 1.4 |
| volume of precipitate (vol.%) | — | 0.10 | 0.25 | 0.15 | 0.35 |

*1Boiling point after addition of 3.5% of water
*2100° C. 7 days
*3120° C. 70 hrs. 9/8 inch SBR rubber cup The results given in Table 2 show that the fluids of this invention are superior to the conventional fluids in lowness in volume of precipitate in the rubber swelling test and evaporation loss.

Having now fully described the invention, it will be apparent to one of ordinary skill in the art that many changes and modifications can be made thereto without departing from the spirit or scope of the invention as set forth herein.

What is claimed as new and intended to be covered by Letters Patent is:

1. A hydraulic fluid composition which comprises (A) at least one nitrogen atom-containing borate ester having the formula:

$$B\begin{cases}[O{-}(A_1O)_{m1}{-}R_1]_x \\ [O{-}(A_2O)_{m2}{-}R_2]_y \\ [OR_3]_z\end{cases} \quad (1)$$

wherein $A_1$ and $A_2$ are independently $C_2$–$C_4$ alkylene, $R_1$ and $R_2$ are independently $C_1$–$C_4$ alkyl, $m_1$ and $M_2$ are independently 2 to 8, $R_3$ is a residue of an oxyalkylated heterocyclic amine or of an oxyalkylated alicyclic amine, x and y are zero, 1 or 2, z is 1, 2 or 3, and x, y and z satisfy the equation $x+y+z=3$, and when z is 2 or 3, $R_3$ are same or different; and (B) at least one fluid selected from the group consisting of (a) other borate esters, (b) polyoxyalkylene compounds, and (c) mixtures of (a) and (b), wherein component (A) is present in a sufficient amount to provide a composition having improved wet reflux boiling point with respect to conventional polyoxyalkylene hydraulic fluids and reduced tendency to form precipitates as compared with conventional borate ester hydraulic fluids in the rubber swelling test according to JIS rubber swelling test K 2233.

2. The composition of claim 1, $R_3$ is shown by the formula:

$$-(A_3O)_r-A_3-R'_3$$

wherein $A_3$ is $C_2$–$C_4$ alkylene, r is 0 to 4 and $R'_3$ is a residue of a heterocyclic monoamine or an alicyclic monoamine.

3. The composition of claim 2, wherein the heterocyclic monoamine is pyrrole, pyrrolidine, pyrroline, 2-pyrrolidone or morpholine.

4. The compositions of claim 2, wherein the alicyclic monoamine is cyclohexylamine or dicyclohexylamine.

5. The composition of claim 1, wherein the oxyalkylated heterocyclic amine is oxyethylated or oxypropylated morpholine.

6. The compound of claim 1, wherein the oxyalkylated alicyclic amine is N-hydroxyethyl cyclohexylamine or N-hydroxypropyl cyclohexylamine.

7. The composition of claim 1, wherein (a) is at least one borate ester of the formula:

$$\begin{array}{l} \quad\;\; [O(A_4O)_{m4}-R]_{x'} \\ B-[O(A_5O)_{m5}-H]_{y'} \\ \quad\;\; O\{-(A_6O)_q-R_4-[(OA_6)_q-OH]_{p-1}\}_{z'} \end{array} \qquad (7)$$

wherein x', y' and z' are independently zero or integer from 1 to 3, and satisfy the equation $x'+y'+z'=3$, R is $C_1$–$C_4$ alkyl, $R_4$ is a residue of a $C_1$–$C_8$ mono-ol or $C_1$–$C_8$ polyol having p hydroxyl groups; $A_3$, $A_4$ and $A_5$ are independently $C_2$–$C_4$ alkylene; m4 is 2 to 8, m5 is 2 to 10, p is 1 to 4 and q is a number such that the molecular weight of group $\{(A_6O)_q-R_4-[(AO_6)_q-OH]_{p-1}\}z'$ is 1000 to 5000.

8. The composition of claim 1 or 7, wherein (a) has a boron content of 0.1 to 4.6% by weight.

9. The composition of claim 1, wherein (b) is at least one selected from the group consisting of (i) polyglycol mono or diethers having the formula:

$$R_5(OA_7)_{m7}OR_6 \qquad (8)$$

wherein $A_7$ is $C_2$–$C_4$ alkylene, $R_5$ is $C_1$–$C_4$ alkyl, $R_6$ is H or $C_1$–$C_4$ alkyl and m7 is 2 to 8, (ii) polyglycol having the formula:

$$H(OA_8)_{m8}-OH \qquad (9)$$

wherein $A_8$ is $C_2$–$C_4$ alkylene and m8 is 2 to 10, (iii) polyoxyalkylene mono- or polyols having the formula:

$$R_7-[(OA_9)_{q'}-OH]_{p'} \qquad (10)$$

wherein $R_7$ is a residue of a $C_1$–$C_8$ monool or $C_1$–$C_8$ polyol $A_9$ is a $C_2$–$C_4$ alkylene, p' is 1 to 4 and q' is a number such that the molecular weight of polyoxyalkylene mono- or polyol (iii) is 1000 to 5000, and (iv) mixtures of two or more of (i), (ii), (iii), and (iv).

10. The composition of claim 1, wherein the amount of (A) is 10 to 45% and the amount of (B) is 90 to 55%, based on the total weight of the composition.

11. The composition of claim 1, which has a boron content of 0.1 to 4.6% by weight.

12. The composition of claim 1, wherein the total amount of (A) and (a) is 10 to 60%, based on the total weight of the composition.

13. The composition of claim 1, wherein the amount of (i) is 0 to 80%, based on the total weight of the composition.

14. The composition of claim 1, wherein the amount of (i) is 40 to 70%, based on the total weight of the composition.

15. The composition of claim 1, wherein the total amount of (ii) and (iii) is 0 to 40%, based on the total weight of the composition.

16. The composition of claim 1, wherein 0 to 10%, based on the total weight of the composition, of at least one additional component (c) is incorporated, selected from the group consisting of antioxidants, corrosion inhibitors, rubber age resistors, PH adjusters and antifoam agents.

17. The composition of claim 1, wherein said residue of an oxyalkylated heterocyclic amine or an oxyalkylated alicyclic amine is a compound having the structure of an addition product of at lease one alkylene oxide with a heterocyclic amine or alicyclic amine having at least one hydrogen atom.

18. The composition of claim 1 wherein said residue of a heterocyclic monoamine has the formula

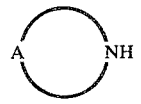

wherein A is a divalent organic radical or N-aminoalkyl ($C_1$–$C_4$) derivative thereof.

19. The composition of claim 18 wherein A is selected from the group consisting of divalent hydrocarbon radicals and divalent organic radicals containing one or more hetero atoms selected from the group consisting of O, N and S.

20. The composition of claim 19 wherein said heterocyclic amine is selected from the group consisting of pyrrolidine, piperidine, pyrrolines, pyrrole, indoline, isoindoline, indole, isoindole, carbazole, morpholine, xanthene, pyrrolidones, imidazolines, imidazole, pyrazole, pyrazolines, purine, 1-H-indazole, piperazine, N-alkyl ($C_{1-4}$) piperazines, imidazolidine, N-alkyl ($C_{1-4}$) imidazolidine, phenothiazine, and N-aminoalkyl ($C_1$–$C_4$) substituted derivatives of these heterocyclic amines.

21. The composition of claim 19 wherein said heterocyclic amine is selected from the group consisting of pyrrolidine, piperidine, pyrrolines, pyrrole, indoline, isoindoline, indole, isoindole, carbazole, morpholine, xanthene, pyrrolidones, imidazolines, imidazole, pyrazole, pyrazolines, purine, 1-H-indazole, peperazine, N-alkyl ($C_{1-4}$) piperazines, imidazolidine, N-alkyl ($C_{1-4}$) imidazolidine and phenothiazine.

22. The composition of claim 17 wherein said alicyclic amine is selected from the group consisting of cyclohexylamine, alkyl ($C_{1-4}$) cyclohexylamines, dicyclohexylamine, 1, 4-diaminocyclohexane and 4, 4'-dicyclohexyl methane diamine.

23. The composition of claim 17 wherein said alkylene oxide contains 2–4 carbon atoms.

24. The composition of claim 17 wherein said addition product contains 1–8 moles of alkylene oxide per mole of amine.

25. The composition of claim 7 wherein said borate ester is a reaction product of at least one boron compound capable of forming a borate ester with at least one hydroxyl group-containing compound selected from the group consisting of (I) at least one polyglycol monoether, (II) at least one polyglycol and (III) at least one polyoxyalkylene mone- or polyol having a molecular weight of up to 5000.

26. The composition of claim 25 wherein the molecular weight of said polyoxyalkylene mono- or polyol is from 1000 to 5000.

27. The composition of claim 25 wherein said borate ester is the reaction product of at least one boron compound capable of forming borate esters with a hydroxyl group-containing compound selected from the group consisting of: (I) at least one polyglycol monoether of the formula $$R—(OA_4)_{m4}—OH$$

wherein R is $C_1$–$C_4$ alkyl, $A_4$ is $C_2$–$C_4$ alkylene and m4 is 2 to 8, (II) at least one polyglycol of the formula $$H—(OA_3)_{m5}—OH$$

wherein $A_3$ is $C_2$–$C_4$ alkylene and m5 is 2 to 10; and (III) at least one polyoxyalkylene mono- or polyol of the formula $$R_4[—(OA_6)_q—OH]_p$$

wherein $R_4$ is a residue of a $C_1$–$C_8$ mono-ol or $C_1$–$C_8$ poly-ol, $A_6$ is $C_2$–$C_4$ alkylene, p is 1 to 4 and q is a number such that molecular weight of component (III) is 1000 to 5000.

28. The composition of claim 1 or claim 7 wherein said borate ester has a boron content of 0.2 to 1.6% by weight.

29. The composition of claim 13 wherein component (A) is present in an amount of at least 10% by weight, based on the total weight of the hydraulic fluid composition.

30. The composition of claim 10 wherein the amount of (A) is 15 to 35% by weight and the amount of (B) is 65 to 85% by weight.

31. The composition of claim 11 wherein the boron content is 0.2 to 1.6% by weight.

32. The composition of claim 13 wherein component (A) is present in an amount of 10 to 45% by weight, based on the total weight of the hydraulic fluid composition.

* * * * *